United States Patent [19]

Sakudo et al.

[11] Patent Number: 4,629,930

[45] Date of Patent: Dec. 16, 1986

[54] PLASMA ION SOURCE

[75] Inventors: Noriyuki Sakudo, Ohme; Osami Okada, Chofu; Susumu Ozasa, Kashiwa; Katsumi Tokiguchi, Machida; Hidemi Koike, Tokorozawa; Shunroku Taya, Mito; Mitsunori Komatsumoto; Mitsuo Komatsu, both of Katsuta, all of Japan

[73] Assignee: Hitachi, Ltd., Tokyo, Japan

[21] Appl. No.: 517,696

[22] Filed: Jul. 27, 1983

[30] Foreign Application Priority Data

Jul. 30, 1982 [JP] Japan ..... 57-131930

[51] Int. Cl.[4] ..... H05H 19/00

[52] U.S. Cl. ..... 313/359.1; 313/230; 313/336

[58] Field of Search ..... 313/313, 231, 41, 359.1, 313/360.1, 361.1, 616, 590, 230, 336

[56] References Cited

U.S. PATENT DOCUMENTS 3,767,952 10/1973 Ormrod ..... 313/230
3,814,975 6/1974 Wolfe et al. ..... 313/336
4,058,748 11/1977 Sakudo et al. ..... 313/230
4,123,686 10/1978 Keller et al. ..... 313/230
4,467,240 8/1984 Futamoto et al. ..... 313/336

FOREIGN PATENT DOCUMENTS 55-93644 7/1980 Japan .

*Primary Examiner*—S. Leon Bashore
*Assistant Examiner*—Michael K. Boyer
*Attorney, Agent, or Firm*—Antonelli, Terry & Wands

[57] ABSTRACT

A plasma ion source includes a discharge chamber in which a plasma is produced by plasma generator, with an acceleration electrode being disposed adjacent to the discharge chamber in order to extract ions from the produced plasma. A deceleration electrode is disposed adjacent to the acceleration electrode to decelerate the extracted ions, and a ground electrode is disposed adjacent to the deceleration electrode. An insulator container is disposed so as to surround the discharge chamber and the respective electrodes, and a shield ring electrode of ground potential is disposed in the vicinity of the deceleration electrode and along an inner wall surface of the insulator container in order to prevent any discharge from arising across the deceleration electrode and the ground electrode.

5 Claims, 6 Drawing Figures

PLASMA ION SOURCE

BACKGROUND OF THE INVENTION

The present invention relates to a plasma ion source in which an ion acceleration voltage for extracting ions from within a plasma is high, and, more particularly, to extraction lenses in the ion source of this type.

A microwave plasma ion source is disclosed in, for example, U.S. Pat. No. 4,058,748 and Japanese Laid Open Patent Publication 55-93644 ions are extracted from within a plasma with a high extraction voltage.

A microwave plasma ion source of the aforementioned type is used in an ion implanter for implanting ions into semiconductor wafers.

When, in the microwave plasma ion source, the acceleration voltage to be applied to the acceleration electrode set at approximately 50 kV in order to increase the energy of the ion beam, a D.C. discharge of unknown cause across the deceleration electrode and the grounded electrode, so the acceleration voltage could not be supplied with a high voltage of at least 50 kV. This problem makes it impossible to cope with the requirements of ion implanters for increasingly higher acceleration voltages, and any countermeasure is desired. Such problem of discharge in an extraction electrode system arises, not only in the microwave plasma ion source as stated above, but also in other plasma ion sources in common.

It is accordingly an object of the present invention to provide a plasma ion source which is free from the problem described above, that is, which can extract an ion beam of high energy.

According to the present invention, a plasma ion source includes a discharge chamber in which a plasma is produced by plasma generation means, an acceleration electrode disposed adjacent to the discharge chamber to extract ions from the produced plasma, a deceleration electrode disposed adjacent to said acceleration electrode to decelerate the extracted ions, a ground electrode disposed adjacent to said deceleration electrode, a container made of an insulator surrounding the discharge chamber and the respective electrodes, and a shield ring electrode of ground potential disposed in a vicinity of the deceleration electrode and along an inner wall surface of the insulator container in order to prevent any discharge from arising across the deceleration electrode and the ground electrode.

Due to the features of the present invention, unlike the prior art in which the electric discharge begins to arise across the electrodes at the acceleration voltage of 50 kV, it is possible to prevent the interelectrode discharge even with an acceleration voltage of 80 kV. As a result, a plasma ion source capable of extracting an ion beam of high energy can be provided, and an ion implanter of high performance can be realized by employing such plasma ion source.

DETAILED DESCRIPTION

Figure 1:
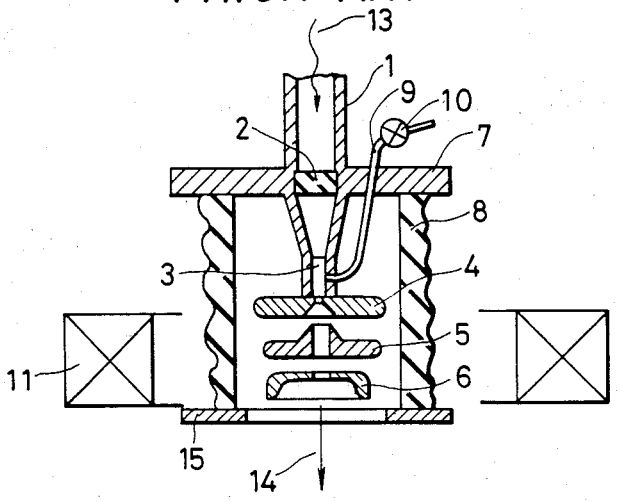
FIG. 1 PRIOR ART
FIG. 1 is a sectional structural view of a prior-art microwave plasma ion source.

Referring now to the drawings wherein like reference numerals are used throughout the various views to designate like parts and, more particularly, to FIG. 1, in a microwave plasma ion source of the type disclosed in, for example, Japanese Patent Publication 55-93644, a microwave 13 is generated by a microwave generator such as a magnetron (not shown), with the microwave 13 propagating along a circular or rectangular wave guide 1, passing through a vacuum sealing dielectric plate 2, and being introduced into a discharge chamber 3 having a pair of confronting ridge electrodes (not shown). A feed gas such as phosphine ($PH_3$) is introduced into the discharge chamber 3 through a gas inlet pipe 9 by opening a needle valve 10.

The feed gas, introduced into the discharge chamber 3, discharges under the synergistic action of a microwave electric field formed across the ridge electrodes and a magnetic field formed by a solenoid 11, so that a plasma is generated in the discharge chamber 3.

Figure 2:
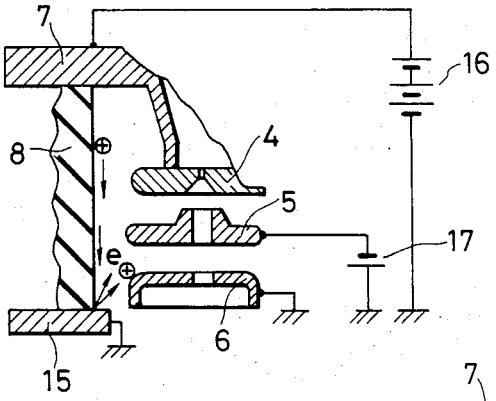
FIGS. 2 and 3 are explanatory views for elucidating the principle of the present invention.

The discharge chamber 3 is usually held at a positive potential of several tens kV through an insulator 8, along with a flange 7 and an acceleration electrode 4. From the plasma produced, ions are extracted through the slit of the acceleration electrode disposed adjacent to the discharge chamber 3. The extracted ions advance toward a deceleration electrode 5 adjoining the acceleration electrode 4 and further pass through a grounded electrode 6 adjoining the deceleration electrode 5, so as to be extracted as an ion beam 14. The decleartion electrode 5 is usually held at a negative potential of several kV. Various experiments and studies were made on the cause of the interelectrode discharge in the prior-art plasma ion source of FIG. 1, and it has been conjectured that the electric discharge result from the following factors. As shown in FIG. 2, the inner wall surface of the insulator container 8 is stained due to the operation of the plasma ion source, and electric charges ⊕ on the inner wall surface flow from the side of the flange 7 toward the side of a base 15. As a result, the electric potential distribution of the inner wall surface of the insulator container 8 becomes quite different from that at the time at which the inner wall surface of the insulator container 8 was in a clean state. The high potential region of the flange 7 supplied with the high voltage by an acceleration voltage source 16 extends near to the grounded base 15. Then, the base 15 is bombarded with the ions ⊕ by the surface creepage or by the migration of the charges ⊕ in the vacuum, so that electrons e and ions ⊕ are emitted from the base 15. The emitted charged particles e and ⊕ enter the space between the grounded electrode 6 and the deceleration electrode 5 supplied with a negative voltage by a deceleration voltage source 17. Therefore, the discharge takes place across the deceleration electrode 5 and the ground electrode 6 and generates a plasma. It is conjectured that the plasma triggers the discharge on the acceleration electrode 4 and makes it impossible to apply the high voltage to the acceleration electrode 4.

Figure 3:
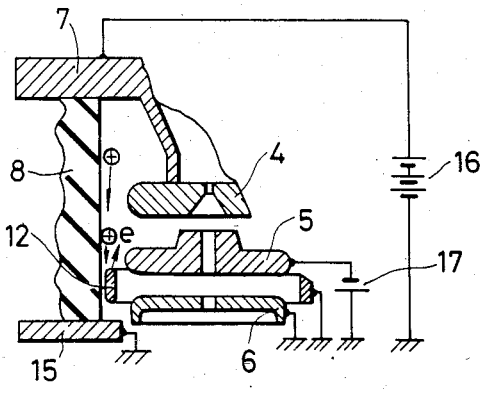

In order to prevent the aforementioned discharge across the deceleration electrode 5 and the ground electrode 6, two measures may be taken, namely, reducing to the utmost the charged particles e and ⊕ which develop due to the surface current flowing on the inner wall surface of the insulator container 8, and preventing the developing charged particles e and ⊕ from entering the space between the deceleration electrode 5 and the ground electrode 6. As shown in FIG. 3, a shield ring electrode 12 may be disposed in the vicinity of the deceleration electrode 5 and along the inner wall surface of the insulator container 8. The grounded shield ring electrode 12 is held in contact with or in close proximity to the insulator container 8. The provision of such shield ring electrode 12 makes it possible to reduce the charged particles e and ⊕ attributed to the surface current flowing on the inner wall surface of the insulator container 8, and also to prevent the generated charged particles from entering the space between the deceleration electrode 5 and the ground electrode 6, so that the discharge across the deceleration electrode 5 and the ground electrode 6 can be perfectly prevented. It turns out that a high voltage of or above 50 kV can be applied to the acceleration electrode 4 and that an ion beam of high energy can be extracted.

Figure 4:
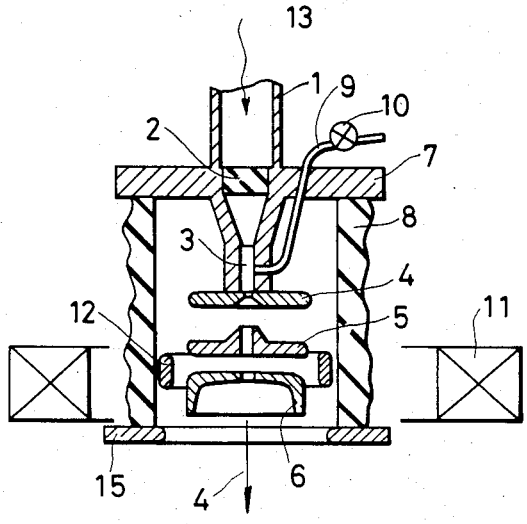
FIG. 4 is a sectional structural view of a microwave plasma ion source according to the present invention.

As shown in FIG. 4, in a microwave plasma ion source according to the present invention, a microwave 13, generated by a magnetron (not shown) having an output of 600 W and a frequency of 2.45 GHz, propagates along a rectangular waveguide 1 made of copper and passes through a vacuum sealing dielectric plate 2 made of alumina ceramic, so as to be introduced into a discharge chamber 3 having a pair of confronting ridge electrodes (not shown) made of copper. A feed gas such as phosphine ($PH_3$) the discharge chamber 3 through a gas inlet pipe 9 by opening a needle valve 10. The $PH_3$ gas feed introduced into the discharge chamber 3 discharges under the synergistic action of a microwave electric field formed between the ridge electrodes and a D.C. magnetic field of about 1000 gausses formed by a solenoid 11. Thus, a plasma is formed within the discharge chamber 3. Phosphorous ions ($P^+$) are extracted from the produced plasma through the slit of an acceleration electrode 4, of stainless steel, disposed adjacent to the discharge chamber 3 and to which an acceleration voltage of +70 kV is applied. The extracted $P^+$ ions advance toward a deceleration electrode 5, of stainless steel disposed adjacent to the acceleration electrode 4 and to which a deceleration voltage of −2 kV is applied. Further, they pass through a ground electrode 6, of stainless steel, disposed adjacent to the deceleration electrode 5 and which is grounded. Then, they are extracted as a $P^+$ ion beam 14. Of course, a grounded shield ring electrode 12, of stainless steel, forming the most significant feature of the present invention is disposed in the vicinity of the deceleration electrode 5 and along the inner wall surface of the insulator container 8 in close proximity thereto.

The $P^+$ ion beam 14 of high energy can be stably extracted from such microwave plasma ion source over a long time, and the interelectrode discharge as in the prior art does not arise. Further, when the extraction of the $P^+$ ion beam was conducted over a long time at an acceleration voltage raised to 80 kV, no interelectrode discharge arose as in the case of 70 kV, and a stable $P^+$ ion beam of high energy was obtained.

Figure 5:
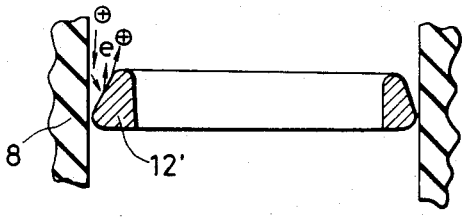
FIGS. 5 and 6 are sectional structural views each showing a shield ring electrode in another embodiment of the present invention.

As shown in FIG. 5, in a shield ring electrode 12' of another plasma ion source according to the present invention, the distance between its surface opposes to the insulator container 8 and the inner surface of the insulator container 8 increases or widens gradually toward the acceleration electrode 4. With such a construction a diffusion space for the charged particles generated by the bombardment of the shield ring electrode 12' with the charges ⊕ having flowed along the inner wall surface of the insulator container 8 can be limited to a space defined by the insulator container 8 and the shield ring electrode 12', so that the charged particles ⊕ and e generated at this time can be prevented from widely diffusing into the other spaces. As a result, the charged particles ⊕ and e can be more effectively prevented from entering the space between the deceleration electrode 5 and the ground electrode 6.

Figure 6:
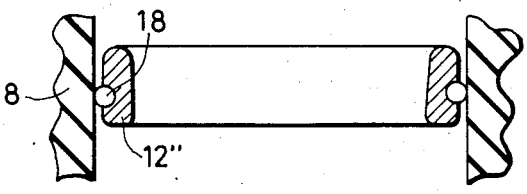

In FIG. 6, a shield ring electrode 12'' another plasma ion source according to the present invention includes a ring-shaped spring 18 for contacting with the insulator container 8. Usually, it is difficult to provide for high dimensional accuracy of an insulator container 8 because it is a sintered insulator. Consequently, the distance between the shield ring electrode 12'' and the insulator container 8 tends to be nonuniform depending upon places. For this reason, when, for example, the distance between the shield ring electrode 12'' and the insulator container 8 is too great, the energy at which the surface of the shield ring electrode 12'' is bombarded with the charges having flowed on the inner wall surface of the insulator container 8 becomes great, and an increased number of charged particles are generated at that time, so that the discharge across the electrodes is liable to be triggered. Therefore, the contact state between the shield ring electrode 12'' and the insulator container 8 is improved by equipping the shield ring electrode 12'' with the ring-shaped spring 18 as shown in FIG. 6.

In this manner, the functions of the shield ring electrode 12 are first to reduce the charged particles which are generated when the charges flowing on the surface of the insulator container 8 bump into the base 15, and second to prevent the generated charged particles from entering the space between the deceleration electrode 5 and the ground electrode 6.

It is accordingly desirable that the diametrical dimension of the shield ring electrode 12 be larger than the diameters of the deceleration electrode 5 and the ground electrode 6. As the position of installation of the shield ring electrode 12, it is desirable that the top plane of the shield ring electrode 12 lie, at least, above the top plane of the ground electrode 6.

As set forth above, the present invention has made it possible to raise an acceleration voltage to 80 kV from 50 kV in the prior art. As a result, a plasma ion source from which an ion beam of high energy can be extracted can be provided, and an ion implanter of high performance can be realized by employing such plasma ion source.

While all the foregoing embodiments have referred to the microwave plasma ion source, it is needless to say that the present invention is not restricted to such plasma ion source but that it is similarly applicable to other plasma ion sources.

We claim:

1. A plasma ion source comprising a discharge chamber in which a plasma is produced by plasma generation means, an acceleration electrode disposed adjacent to said discharge chamber to extract ions from the produced plasma, a deceleration electrode disposed adjacent to said acceleration electrode in order to decelerate the extracted ions, a ground electrode disposed adjacent to said deceleration electrode and through which the extracted ions pass to be extracted as an ion beam, a container made of an insulator surrounding said discharge chamber and the respective electrodes, and discharge preventing means, including a shield ring electrode of ground potential disposed in a vicinity of said deceleration electrode and along an inner wall surface of said insulator container, for preventing any discharge from arising across said deceleration electrode and said ground electrode by reducing the flow of charged particles developed due to surface current flowing along the inner wall surface of said insulator container and preventing the charged particles from entering a space between said deceleration electrode and said ground electrode, thereby enabling a high voltage of at least 50 kV to be applied to said acceleration electrode and enabling extraction of a high energy ion beam.

2. A plasma ion source according to claim 1, wherein said plasma generation means includes means for producing the plasma by exerting a microwave electric field and a magnetic field on a feed gas introduced into said discharge chamber, said shield ring electrode being disposed with respect to said ground electrode so that a plane of an upper surface of said shield ring electrode lies above a plane of an upper surface of said ground electrode.

3. A plasma ion source comprising a discharge chamber in which a plasma is produced by plasma generation means, an acceleration electrode disposed adjacent to said discharge chamber to extract ions from the produced plasma, a deceleration electrode disposed adjacent to said acceleration electrode in order to decelerate the extracted ions, a ground electrode disposed adjacent to said deceleration electrode, a container made of an insulator surrounding said discharge chamber and the respective electrodes, and a shield ring electrode of ground potential disposed in a vicinity of said deceleration electrode and along an inner wall surface of the insulator container in order to prevent any discharge from arising across said deceleration electrode and said ground electrode, said shield ring electrode includes a spring means for contacting said inner wall surface of said insulator container.

4. A plasma ion source according to any one of claims 1 2, or 3, wherein said shield ring electrode is constructed such that a distance between an outer surface thereof disposed in opposition to said insulator container and an inner surface of said insulator container increases gradually toward said acceleration electrode.

5. A plasma ion source according to claim 3, wherein said plasma generation means includes means for producing the plasma by exerting a microwave electrice field and a magnetic field on a feed gas introduced into said discharge chamber.

* * * * *